US005439053A

United States Patent [19]

Eslinger et al.

[11] Patent Number: 5,439,053

[45] Date of Patent: Aug. 8, 1995

[54] REINFORCING SLAT FOR INFLATABLE PACKER

[75] Inventors: David M. Eslinger, Broken Arrow; Robert M. Sorem, Tulsa, both of Okla.

[73] Assignee: Dowell Schlumberger Incorporated, Houston, Tex.

[21] Appl. No.: 91,789

[22] Filed: Jul. 13, 1993

[51] Int. Cl.[6] ..... E21B 33/127

[52] U.S. Cl. ..... 166/187; 166/196

[58] Field of Search ..... 166/187, 120, 196, 179, 166/192, 195

[56] References Cited

U.S. PATENT DOCUMENTS

| | | | |
|---|---|---|---|
| 4,349,204 | 9/1982 | Malone | 166/187 X |
| 4,492,383 | 1/1985 | Wood | 166/187 X |
| 4,832,120 | 5/1989 | Coronado | 166/187 |
| 4,951,747 | 8/1990 | Coronado | 166/187 |
| 5,101,908 | 4/1992 | Mody | 166/187 |
| 5,109,925 | 5/1992 | Stepp et al. | 166/187 |
| 5,143,154 | 9/1992 | Mody et al. | 166/187 |
| 5,280,824 | 1/1994 | Eslinger et al. | 166/187 |

*Primary Examiner*—Ramon S. Britts
*Assistant Examiner*—Frank S. Tsay
*Attorney, Agent, or Firm*—Henry N. Garrana; Stephen A. Littlefield

[57] ABSTRACT

A reinforcing slat for use in an inflatable packer which is elongate and curved about its longitudinal axis and comprises perforations in the part thereof which enters the end portion and which bends around the end portion on inflation of the packer. The perforations serve to reduce the bending stiffness of the slat in the portion likely to suffer permantent deformation on inflation of the packer.

4 Claims, 3 Drawing Sheets

REINFORCING SLAT FOR INFLATABLE PACKER

FIELD OF THE INVENTION

This invention relates to the art of production of subterranean fluid through a wellbore and more particularly,to a reinforcing slat for an inflatable packer useful in temporarily isolating portions of a wellbore and to a packer incorporating such a slat.

BACKGROUND OF THE INVENTION

Inflatable packers or bridge plugs have long been used in wellbore operations. An inflatable packer typically comprises a tubular base and a surrounding, inflatable elastomeric bladder or sleeve. Fluid passages within the tubular body allow fluids to contact the inflatable bladder and expand the bladder radially outwardly to effect sealing engagement with a borehole or well casing.

Since the elastomeric bladder is subjected to both expansion pressure and abrasion or cutting forces, it has been common to surround the exterior surface of the bladder with a plurality of peripherally overlapping, resilient reinforcing slats or ribs. There is generally sufficient overlap of such slats that upon expansion of the inflatable bladder, the slats remain as a surrounding armor protecting the bladder from abrasion and cuts while also preventing extrusion of the bladder elastomer between the slats in a localized area. The slats are commonly welded to a portion of the assembly to retain their desired position and orientation. U.S. Pat. No. 5,143,154 describes one form of slat weldment.

Because the slats cannot effect the sealing of the packer against a wellbore or casing, at least some portions of the reinforcing slats are surrounded by and may be bonded to an outer annular elastomeric cover or packing element which, upon expansion of the inflatable packer, comes into pressure sealing engagement with the wellbore or casing.

The outer sealing cover generally comprises either a single or a plurality of annular circumferential elastomeric pieces located on the outer surface of the reinforcing slats. When a single elastomeric piece is employed it may cover only a portion of the longitudinal length of the slats or, alternatively, it may cover the entire outer surface of the slats. Such single piece covers generally have a uniform thickness along their length, the thickness generally being substantial. Such arrangements are described in U.S. Pat. Nos. 3,837,947, 4,832,120 and 5,143,154.

Slat reinforced inflatable packers are typically constructed of high strength, cold-worked slats welded to an end connector. The slats are curved about the slat longitudinal axis to increase the in plane bending stiffness but a potential problem arises at the point where the slat bends around the end connector which can lead to permanent deformation of the slat.

SUMMARY OF THE INVENTION

The present invention minimizes the problem of permanent deformation of curved slats near the end connector.

In accordance with the invention, the slats have perforations in the regions where permanent deformation is most likely. The perforations reduce the local bending stiffness of the slat so as to reduce the likelihood of permanent deformation which might prevent the packer from returning to its original size.

BRIEF DESCRIPTION OF THE DRAWINGS

The invention will now be described in greater detail with reference to the accompanying drawings forming a part of the specification and in which.

DETAILED DESCRIPTION OF THE PREFERRED EMBODIMENTS AND THE DRAWINGS

Figure 1:
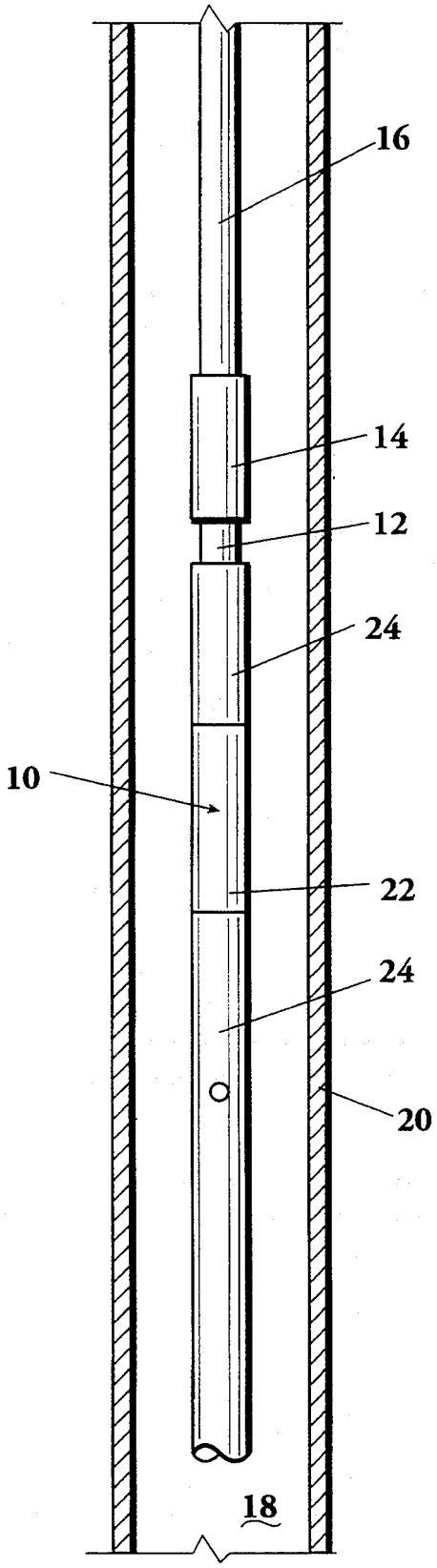
FIG. 1 is a schematic view of an inflatable packer in use prior to inflation.

Referring now to the drawings, which are for the purposes of illustrating the preferred embodiment of the invention only and not for the purposes of limiting same, FIG. 1 schematically illustrates the inflatable packer device in its run-in condition prior to inflation. It will be understood that the inflatable packer may be one packing element of a bridge plug or only a single packer employed to isolate one part of a wellbore from another. The packer element 10 includes a tubular base portion 12 and is interconnected with a coupling number 14 to a tubular string 16 extending to the surface. It will be appreciated that the tubular string 16 can be formed by coupling individual sections of pipe or, in a preferred embodiment of the invention, a continuous length of coiled tubing inserted into the wellbore 18 having a casing 20.

The packer element 10 generally comprises an inflatable portion 22 with at least one and possibly two associated end fittings 24. It will be further understood that the inflatable packer may be associated with one or more downhole tools such as to effect the injection of various fluids into isolated portions of the wellbore 18.

Figure 2:
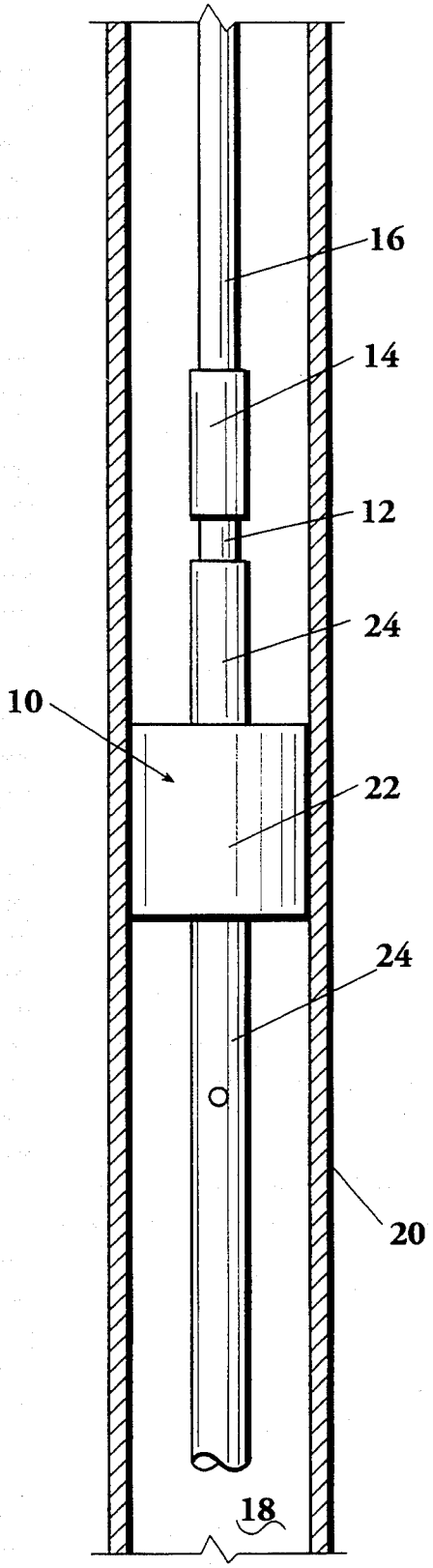
FIG. 2 is a schematic view similar to FIG. 1 showing the inflatable packer in the inflated condition.

At the point desired in the wellbore, the inflatable portion 22 of the packer element 10 is expanded through the application of fluid pressure to the interior of the inflatable portion and expanded outwardly into engagement with the casing 20 (FIG. 2). It will be understood that while the use of the inflatable packer of the present invention is shown in conjunction with a cased borehole, the inflatable packer may also be used in an uncased wellbore under appropriate conditions known to those skilled in the art.

Figure 3:
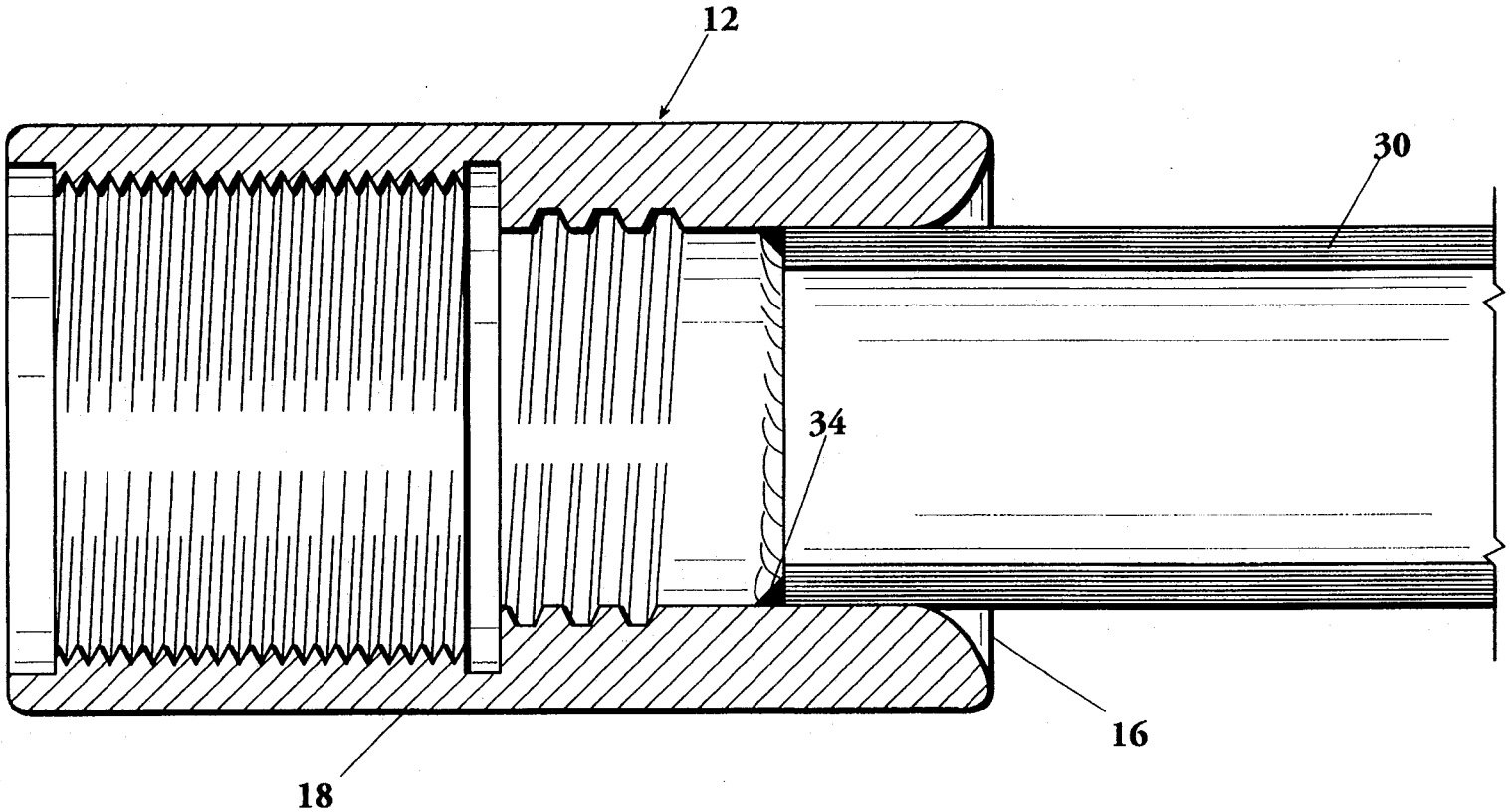
FIG. 3 is a cross sectional view of a portion of an end fitting of the packer shown in FIGS. 1 and 2.

As shown in FIG. 3, a plurality of overlapping slats 30 are welded at their end portions to an end fitting 12 with a weld bead 34. While the assembly is shown with the slats 50 welded to an inner cylindrical surface of the end fitting 12, it will be appreciated that other arrangements are possible such as the welding of the slats 30 to the end face 16 of the end fitting 12 or, possibly, the outer surface 18 of the end fitting 12.

Typically the slat is formed from 301¾ hard stainless steel or 718 inconel having a thickness of typically 0.005 in to 0.025 in. Each slat is curve about its longitudinal axis to increase its in plane bending stiffness.

Figure 4:
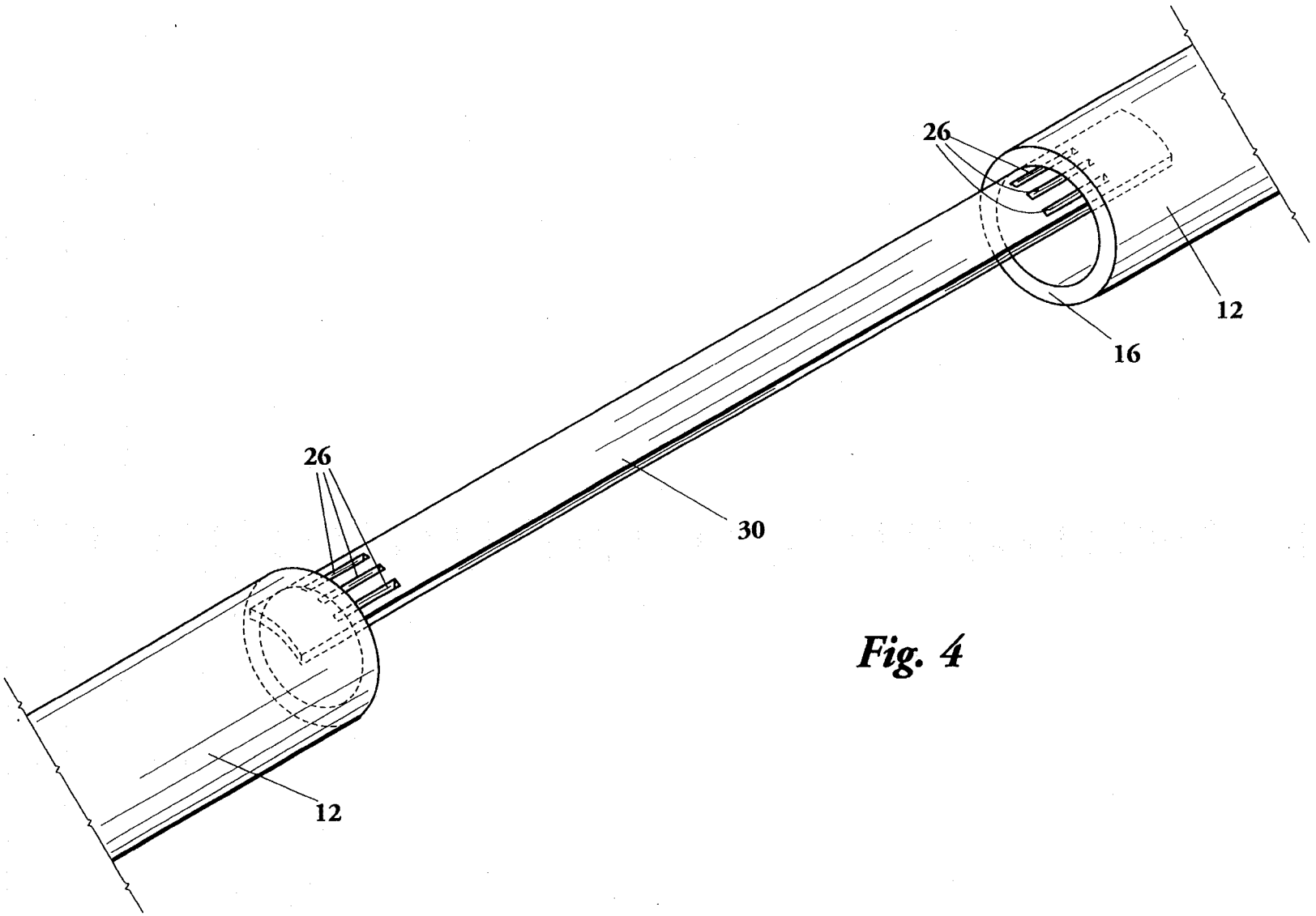
FIG. 4 is a cross-sectional elevation of a portion of the end fitting of an inflatable packer illustrating a slat in accordance with the present invention.

In accordance with the invention and as shown in FIG. 4, each slat 50 is formed with a plurality of slits 26 in the region where the slat 30 bends around the end face 16 of the end fitting 12. The slits 26 are formed by laser machining the slat 30 and are aligned with the logitudinal axis of the slat 30. The optimum nuber of slits 26 in each slat 30 depends on the number of slats 30, their width, thickness and amount of curvature. The slits 26 serve to reduce the bending stiffness by minimizing the effect of curvature in that region.but, because each slit 26 is relatively narrow, the overall strength is not reduced signitficantly. In alternative embodiments of the invention, the slits 26 can be replaced by a series of small holes or eliptical slots to achieve the same effect.

While the invention has been described in the more limited aspects of the preferred embodiment thereof, other embodiments have been suggested and still others will occur to those skilled in the art upon a reading and understanding of the foregoing specification. It is intended that all such embodiments be included within the scope of this invention as limited only by the appended claims.

What is claimed is:

1. A reinforcing slat for use in an inflatable packer comprising end portions having an inflatable bladder extending therebetween and reinforcing slats covering at least part of the bladder and extending into the end portions, wherein the slat is elongate and curved about its longitudinal axis and comprises perforations in the part thereof which enters the end portion and which bends around the end portion on inflation of the packer.

2. A reinforcing slat as claimed in claim 1, wherein the perforations comprise a series of parallel slits aligned with the longitudinal axis of the slat.

3. An inflatable packer comprising end portions having an inflatable bladder extending therebetween and reinforcing slats covering at least part of the bladder and extending into the end portions, wherein each slat is elongate and curved about its longitudinal axis and comprises perforations in the part thereof which enters the end portion and which bends around the end portion on inflation of the packer.

4. An inflatable packer as claimed in claim 3, wherein the perforations in each slat comprise a series of parallel slits aligned with the longitudinal axis of the slat.

* * * * *